United States Patent [19]

Carpenter

[11] 4,127,360

[45] Nov. 28, 1978

[54] BUMPLESS PUMP APPARATUS ADJUSTABLE TO MEET SLAVE SYSTEM NEEDS

[76] Inventor: Clarence W. Carpenter, 8610 Cedarbrake, Houston, Tex. 77055

[21] Appl. No.: 751,137

[22] Filed: Dec. 16, 1976

[51] Int. Cl.[2]... F04B 41/06; F04B 35/04; F04B/7/00

[52] U.S. Cl. ..... 417/5; 417/338; 417/419; 417/516; 417/539; 60/567; 200/83 N

[58] Field of Search ..... 417/419, 417/339, 347, 338, 345, 516, 539, 5, 25, 33, 46, 346, 4, 342, 225; 200/83 N, 83 Q, 83 J, 83 Y; 137/625.4; 60/567; 91/220

[56] References Cited

U.S. PATENT DOCUMENTS

| | | | |
|---|---|---|---|
| 947,908 | 2/1910 | Heglar | 74/29 |
| 1,175,047 | 3/1916 | Clark | 417/25 |
| 1,639,147 | 8/1927 | Phillips et al. | 91/220 |
| 2,421,149 | 5/1947 | Segerstad | 200/83 A |
| 2,936,780 | 5/1960 | Pratt | 200/830 |
| 3,005,067 | 10/1961 | Leibold et al. | 200/83 N |
| 3,532,121 | 10/1970 | Sturman et al. | 137/625.4 |
| 3,554,672 | 1/1971 | Brandes | 417/347 |
| 3,597,113 | 8/1971 | Dumoulin et al. | 417/339 |

FOREIGN PATENT DOCUMENTS

| | | | |
|---|---|---|---|
| 2,347,717 | 3/1974 | Fed. Rep. of Germany | 417/419 |

*Primary Examiner*—Carlton R. Croyle
*Assistant Examiner*—Thomas I. Ross
*Attorney, Agent, or Firm*—Donald Gunn

[57] ABSTRACT

Pumping apparatus which incorporates connected piston type positive displacement, slip free pumps is disclosed. They provide pumped outputs at a common displacement rate. They run out of phase to one another so that while one is pumping, the other is able to refill. A three way valve under control of a pressure responsive switch delivers pumped fluid to the down stream outlet when a pressure match is achieved. The apparatus finds application as a constant rate continuous fluid injection pump.

12 Claims, 5 Drawing Figures

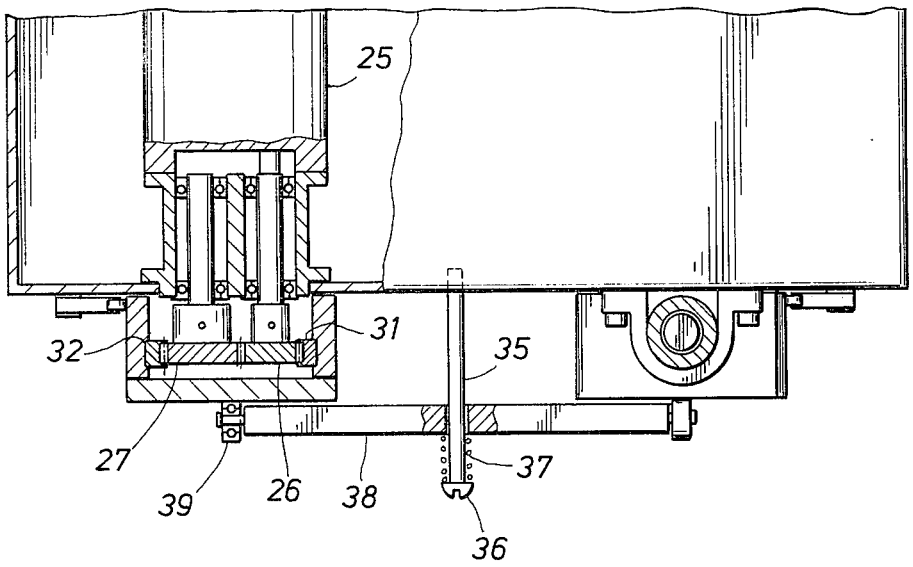
FIG. 3
FIG. 5
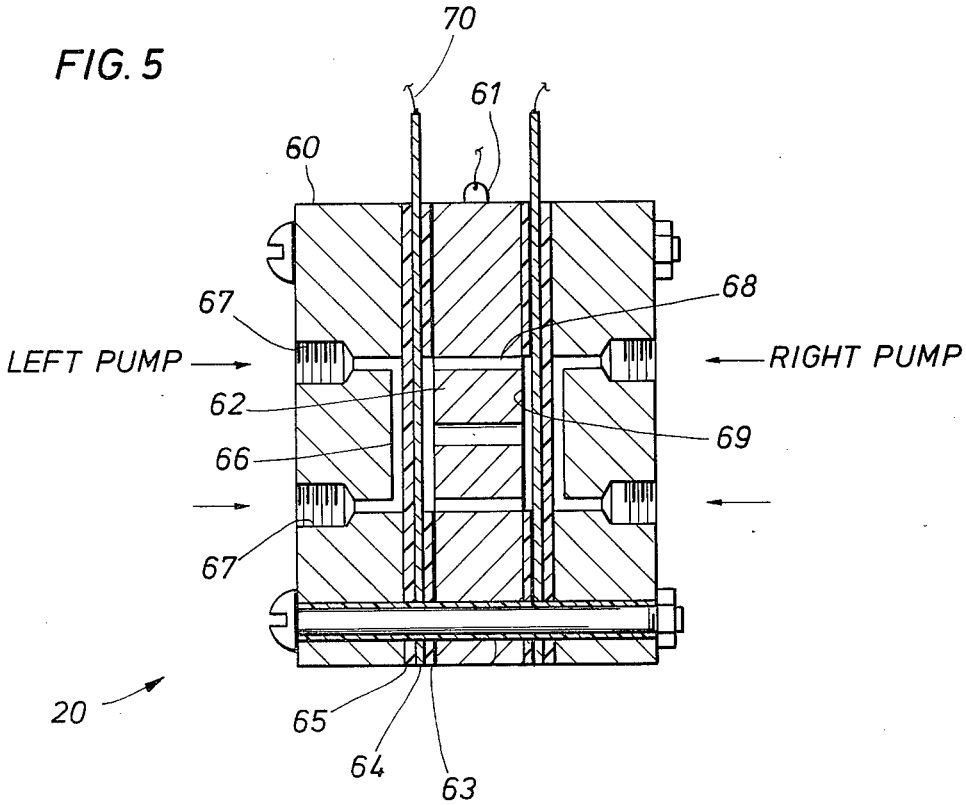

BUMPLESS PUMP APPARATUS ADJUSTABLE TO MEET SLAVE SYSTEM NEEDS

BACKGROUND OF THE INVENTION

This disclosure is directed to a bumpless constant rate pumping system. Constant rate pumps are often required in many circumstances. For instance, in a refining process, it may be necessary to inject a minute quantity of a trace constituent into a vessel against a wide range of back pressures including low to high pressures. The apparatus of the present disclosure is directed to a pump which provides such an output, namely, a constant rate of flow which is pumped at a specified pressure without bumps or pulsations in the flow rate dependent on the type of the connective tubing.

There have been attempts in the past to provide various and sundry constant rate systems. The apparatus of this disclosure is apt to be an improvement over them. The apparatus is an improvement in the sense that it provides a rate of flow which is constant. The rate of flow is maintained steady and free of pulsations or bumps dependent on system materials. For example, flexible plastic tubing can be used but it yields to pressure and hence serves as a somewhat inferior material to metal tubing. Metal conduit is, however, more costly and is used only when the performance required demands the expense. Heretofore, multicylinder pumping mechanisms have found favor. They ordinarily, however, have difficulty in achieving a switchover where the flow is coming from a first cylinder and thereafter additional cylinders in the apparatus. The switch-over from a first to a subsequent cylinder has heretofore entailed a periodic bump or surge. These have occurred during pressure build up and drop in the manifold which is common to the several cylinders. Bumps or surges in some circumstances cannot be tolerated. Accordingly, the apparatus of the present invention has overcome this handicap by the provision of a pumping system which is free of bumps and surges when the multiple cylinders cycle in and out of operation.

The present apparatus overcomes these problems. The pumping apparatus disclosed herein is able to pump a fluid at a constant rate from a multicylinder apparatus where the pressure is free of pulses or surges. The apparatus switches from one cylinder to the other in a bumpless fashion.

SUMMARY OF THE INVENTION

This disclosure is directed to a constant rate pumping apparatus using multiple cylinders which are switched into operation in a bumpless fashion. In other words, pressure surges are avoided on switching. To this end, the apparatus incorporates a pair of identical cylinders having pistons therein. The duplicate equipment operates in identical fashion. A stepping motor which rotates a fixed increment of a revolution drives the piston rod at a controlled rate. Duplicate equipment is used for each cylinder so that each piston rod is driven at the same rate. They run 180° out of phase with one another. The pumping action of one pump is terminated and the other pump is begun in response to pressure levels sensed by a three terminal pressure actuated switch. The apparatus includes a drive means for stepping motors which stepping motors are mechanically connected by means of a gear drive system and a rack and pinion to piston rods which extend into the respective cylinders. Limit switches are included to prevent overrunning. The preferred construction of a differential pressure cross over switch utilizes a pair of diaphragms which are exposed to the pressure sources, and contacts which are carried by the diaphragms.

DESCRIPTION OF THE DRAWINGS

FIG. 3 is a sectional view along the line 3—3 of FIG. 1 showing an alignment mechanism for the pump power apparatus;

FIG. 5 is a sectional view through a special switch which is responsive to pressure switch over.

DESCRIPTION OF THE PREFERRED EMBODIMENT

Figure 1:
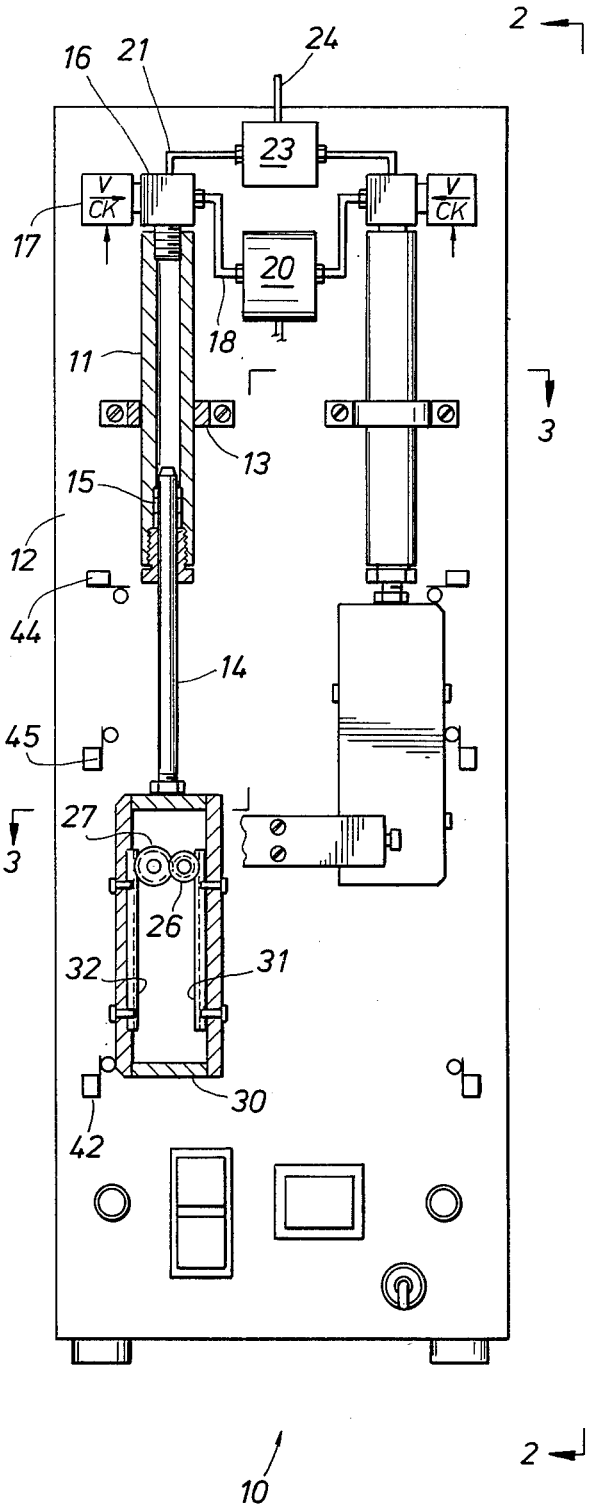
FIG. 1 is a front view of the double cylinder pumping apparatus of the present invention.

Attention is first directed to FIG. 1 of the drawings where the pump apparatus of the present invention is identified by the numeral 10. The pump apparatus will be described in detail and thereafter, the operation will be stated. It includes a cylinder 11 which is fastened to a mounting plate 12 by a clamp mechanism 13. The cylinder 11 is hollow. A piston rod 14 is inserted into the cylinder through a suitable packing 15 which defines one end of the cylinder. The piston rod 14 is inserted to force fluid from the cylinder 11. At the opposite end, the cylinder 11 is connected to an outlet port 16 which is a fourway connector. Fluid to be pumped is introduced through a check valve 17. The check valve 17 communicates directly to the fourway connector 16. The fluid thus introduced is delivered into the cylinder 11 to be pumped. The numeral 18 identifies an outlet line. The line 18 is directed to a differential pressure responsive switch 20. The switch 20 will be described in detail hereinafter. Pressure is communicated through the line 18 but the flow in this line is nil. Flow through sensors can be used if desired. The flow in the line 21 is to a valve 23 which is connected to an outlet line 24. The valve 23 is solenoid operated to open one side or the other. As will be observed in FIG. 1, duplicate equipment is provided on both sides of the mounting plate 12. The two pumps are thus connected to the tee 23 and then to the outlet line 24. The valve 23 is preferably switched to open one pump output and close the other synchronously. The valve 23 is preferably a solenoid valve but it also can be a motorized rotary valve, selector valve, or other driven valve.

When the piston rod 14 moves downwardly in the cylinder 11, an intake stroke occurs. The intake stroke draws fluid into the system through the check valve 17. When a pressure stroke occurs on movement in the opposite direction, fluid is forced from the cylinder 11 through the outlet line 21. When this occurs, the fluid expelled from the cylinder 11 passes through the outlet valve 23. Again, it will be kept in mind that there is normally no flow through the conduit 18. Rather it communicates to a pressure responsive transducer.

Figure 2:
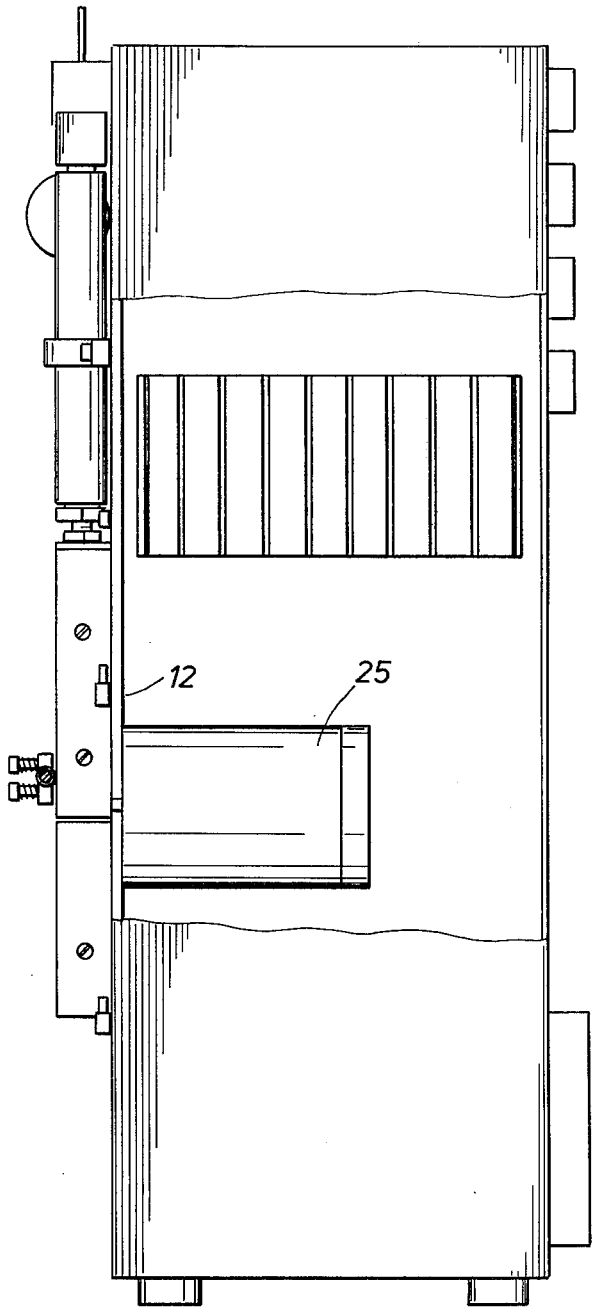
FIG. 2 is a side view of the apparatus shown in FIG. 1.

A stepping motor 25 is shown in FIG. 2. The preferred motor is a stepping motor. It has a housing which is mounted to the back of plate 12. A hole is formed in the plate 12 (FIG. 3) and the drive shaft of the stepping motor 25 extends therethrough and supports a drive gear 26 shown in FIG. 1. The drive gear 26 is engaged with an idler gear 27.

The piston rod 14 is bolted or otherwise attached to the end of a rectangular or box-like clevis structure 30. It has two long sides and two short sides. The long sides support a pair of parallel gear racks 31 and 32. They are bolted on the inside facing one another. They are preferably parallel to one another. They are spaced apart by a distance to enable them to mesh with the gears 26 and 27. The gear 26 is driven by the stepping motor 25. It imparts linear or axial movement to the piston rod 14. The idler gear 27 functions in a like manner. Thus, the two gears together cooperatively force the piston rod to reciprocate upwardly and downwardly. The arrangement wherein facing racks are incorporated stabilizes the piston rod 14 against wobble. It enables smooth movement of the piston rod to and fro. Moreover, it cuts down on backlash in the gearing system. Further, it aligns the push rod 14 because it is clamped about the gears and is therefore unable to wobble to the right or left as viewed in FIG. 1 of the drawings. Preferably, the racks 31 and 32 are identical in construction and length. Preferably, the length exceeds the maximum stroke of the piston rod. To this end, the gears 26 and 27 engage the adjacent racks and mesh with the teeth while traveling toward the ends of the racks. This enables the apparatus to impart a steady and consistent stroke to the piston rod.

The pump shown on the left side of the plate 12 is duplicated on the right. Both pumps have similar outputs to the pressure switch 20 and to the tee valve. They are preferably constructed and arranged parallel to one another.

Attention is next directed to FIG. 3 of the drawings. In FIG. 3, the numeral 35 identifies an upstanding post attached to the mounting plate 12. The post 35 has a head 36 on it with a coil spring 37 about the post 35. The coil spring pushes downwardly against a transversely mounted bar 38. The bar 38 extends over the clevis 30, it being kept in mind that the clevis 30 is attached to and aligned with the cylinder. Preferably, two such posts are included as shown in FIG. 1 so the bar 38 is held generally parallel to the plate 12. The bar is urged toward the plate by the coil spring 37. The bar 38 clears the topside of the elongate rectangular clevis 30. It carries a roller 39 on its outer end which bears against the top surface thereof, the roller providing a loading force which urges the rectangular member 30 toward the mounting plate to maintain it in the proper alignment with the cylinder 11. As shown in FIG. 3, duplicated equipment is provided on both sides of the mounting post 35 so that both sets of apparatus are provided with similar guidance.

Returning again to FIG. 1 of the drawings, it will be observed that the clevis reciprocates upwardly and downwardly. At its lower extent of travel, a limit switch 42 senses its arrival. At the upper extent of travel, a similar limit switch 44 senses its arrival. Another switch 45 is arranged between the switches 42 and 44. The switch 44 indicates the arrival of the member 30 at its extreme travel on the intake stroke. It provides a signal to interrupt the pump stroke. The motor 25 when reversed drives the piston rod in the opposite direction. Before the limit of travel is reached, the piston is first sensed by the switch 45. The switch 45 is connected to start the other motor which comes up to speed on a compressive stroke. Both motors operate at the same speed which is proportioned to the frequency of the oscillator connected to them. The motor 25 is an incremental stepping motor which provides 200 incremental steps to one revolution (one step equals 1.8°) and the motor is manufactured by the Superior Manufacturing Co. and sold under the trademark "Slo-Syn." The Superior Manufacturing Co. also supplies an oscillator which forms driving signals for the motor. For better understanding of this, attention is momentarily directed to FIG. 4 of the drawings.

As will be understood, the switch 45 on the left pump starts the right pump on its pressure stroks. For some time both are pumping. They are both connected to the transducer or differential pressure switch 20 which signals when the second pump has come up in pressure to permit the first pump to reverse and refill by an intake stroke. The switch 20 also signals the valve 23 to reverse at the same time. From this description, it will be understood how the two pumps are not perfectly 180° out of phase.

Figure 4:
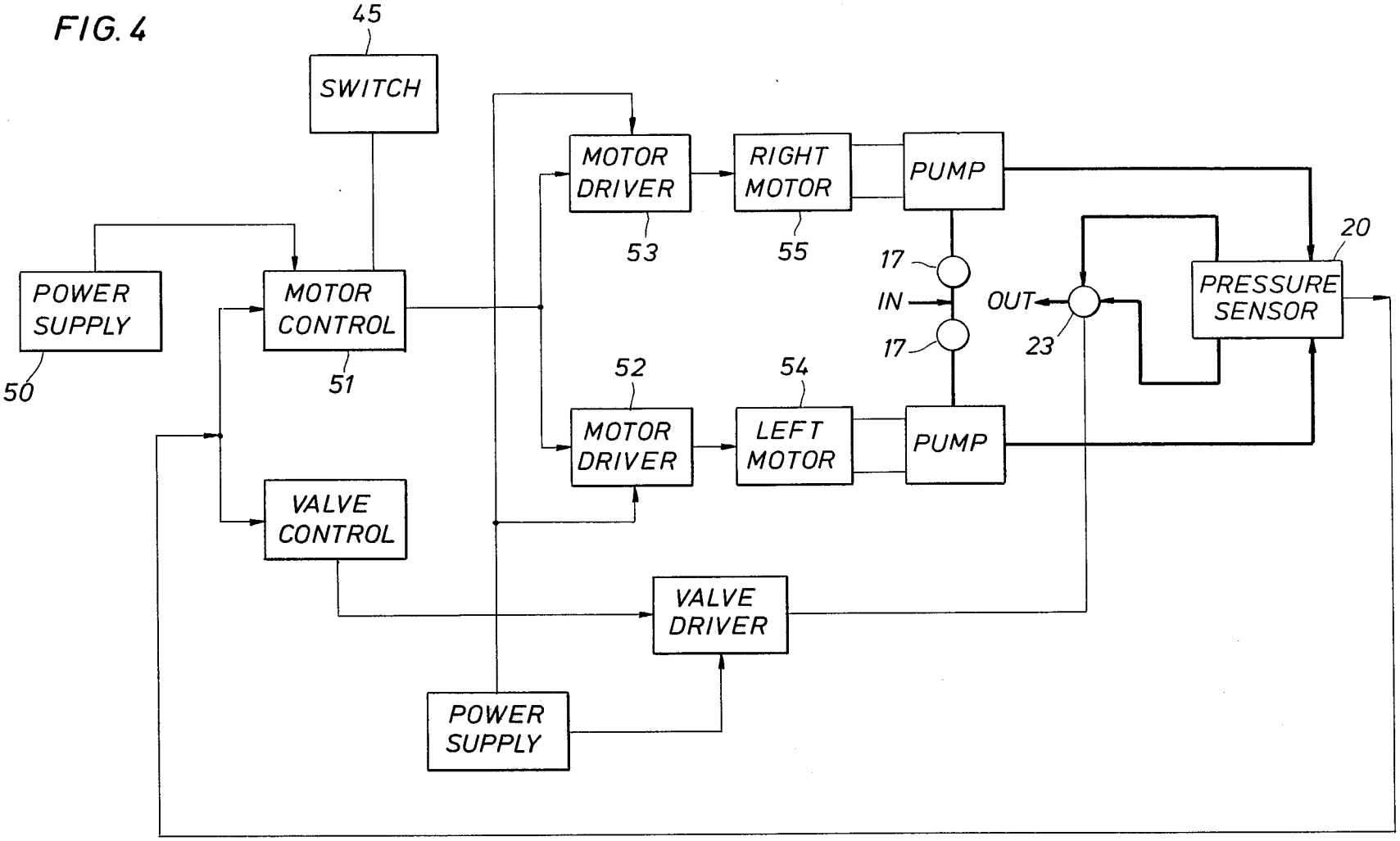
FIG. 4 is a schematic wiring diagram of an electronic drive circuit therefor.

In FIG. 4, the numeral 50 identifies a logic power supply which is connected with a logic circuit 51. The circuit 51 incorporates an oscillator which forms output pulses appropriately shaped (an approximate square wave) and having one of two different frequencies. One frequency is associated with the discharge or up motion of the motor and the other is associated with the refill or down motion of the motor. The logic circuit 51 provides an oscillator output for motor drivers indicated by the numerals 52 and 53. They are identical but are arranged for the two motors respectively incorporated in the equipment. They function identically.

The motor driver 52 is connected to the left hand motor 54. The right hand driver 53 is connected to the right hand motor 55. The motors 54 and 55 shown schematically in FIG. 4 are the motors within the two motor housings 25. Again, it will be noted that two motors are incorporated and they are preferably identical in construction and operation. For a better understanding of the operation of the "Slo-Syn" stepping motor, reference is made to the instruction manual provided in the manual and the detailed schematic furnished by the Superior Manufacturing Co. which depicts the logic circuit 51, the driving circuits 52 and 53 and the power supply circuits for their operation.

The motors run clockwise or counter clockwise depending on the relative polarity of driving pulses applied to them. Similar pulses are applied for rotation in either direction, therebeing only a phase reversal which determines the direction of rotation. The phase reversal is caused by the switch 20 which signal the necessity for reversal. Limit switches 42 and 44 of course are actuated to avoid destructive overrunning.

Attention is next directed to FIG. 5 of the drawings where the differential pressure switch 20 is illustrated in detail. In this drawing, it will be noted that the lines from the left and right pumps are duplicated. This fills the entire chamber of the apparatus and in particular it prevents the occurance of air bubbles in the system, dead end spaces or other traps which might create hysteresis in the operation of the switch. Briefly, the switch incorporates a closed body 60. The body 60 supports a terminal 61 which is connected to a first conductor. This provides an input voltage level. The conductor 61 is connected to an electrical contact. The electrical contact is common to the central body. The central body is generally indicated at 62. The central body 62 is sandwiched on the right and left by duplicate equipment, and to this end, only one side will be described. On the left side, the numeral 63 identifies a gasket which encircles the peripheral edge of the body 62. Immediately adjacent to the gasket, a metal plate 64 is located. The plate 64 is immediately adjacent to a solid diaphragm of resilient material at 65. The diaphragm 65 is exposed to the fluid passage 66 which is connected to the inlet port 67. The diaphragm 65 is deflected by pressure in a cavity 66. The body 62 has a number of hollow passages 68 which are immediately adjacent to a shallow recessed area at 69. The recess at 69 is approximately the same shape and depth as the cavity 66.

On operation, when pressure is applied to the left hand port 67, the pressure is sensed in the shallow cavity 66. The pressure forces the thin diaphragm 65 to the right which deflects the metal diaphragm 64. When it deflects, it is brought into contact with the central body member 62 and creates an electrical contact which is carried away on a conductor 70. In addition, oil captured in the passages 68 is pumped away from the deflected diaphragm 64. When this occurs, the oil increases the pressure in the cavity 69 on the far side of the body. This oil is non-conductive and it impinges on the other metal diaphragm to force it away. As the diaphragms yields slightly, it bows away and breaks any contact which might be had at the other metal diaphragm. Through the use of the non-conductive oil (as an insulative piston) captured on the interior of the system, the central contact 61 is thus contacted against only one of the two outlets. Alternately, the piston can be a non-conductive solid member in lieu of the oil.

The differential pressure switch 20 is thus installed between the two pumps. When the pressure switch 20 senses that the pressure at one side has matched or slightly exceeded the pressure at the other side, it forms a signal which is used in reversing the operation of one of the two stepping motors and in switching the valve 23 from one port to the other. The signal for reversal of the motors is applied to only one motor, it being kept in mind that the signal is actually implemented by the motor driver circuits 52 or 53. This reverses the operation of the motor and pump which has nearly finished its stroke. When it is reversed, the motor which had just started its assigned pump on the pressure stroke continues its stroke. When the pressure switch senses the necessity for a change, the first running motor is reversed, starting its pump in the opposite direction thereby making a bump free switchover. All of this results from the pressure match sensed at the transducer; the materials of construction in part determines the bump free operation.

The "Slo-Syn" stepping motors chosen for the present apparatus are particularly advantageous in that they can be obtained in several sizes. A size is preferably selected to handle the torque load on the motor, but they are preferably not operated any faster than about 400 steps per second. This allows the motors to achieve rather rapid response. Since the motors turn on and run some time before switch over occurs, they do not have to respond extremely fast but must maintain speed within desired pumping rate needs.

The motor driven dual pump arrangement of the present invention meets the intended purpose in providing switch over from one pump to the other without a pressure surge or drop. Moreover, the apparatus is particularly advantageous in providing relatively small volumes at relatively high pressures. This results from bringing the second motor up to speed before the first motor is switched off. The second motor is, of course, the motor driving the pump which is down or withdrawn from the cylinder. In other words, the pump which is ready for the next stroke is the second pump as described in this paragraph. The first pump is the pump which is in the midst of its pumping stroke and tripped the switch 45 to start the second pump. The first pump thus runs until its motor is switched off by operation of the switch 20 or the limit switch 44. Thus, a pump switch over is achieved first by operation of the switch 45 and subsequent operation of the pressure switch 20. As will be understood, the switches 45 are cross connected.

Tracing one cycle of operation, assume the first (it is immaterial which pump) pump is filled and ready to pump. Assume the second pump is ready for an intake stroke. Both strokes begin and the pressure switch 20 and the solenoid operated valve 23 are positioned to direct the flow from the first pump. After some time, the first pump trips its switch 45. This starts the second pump. The pump starts its pressure stroke and it travels at the same rate as the first pump. However, the second pump is now pumping against a closed valve 23. This causes pressure to come up quickly, when sensed by the transducer switch 20, a switch over is ordered. This reverses the valve 23 and reverses the direction of the first pump. The first pump then intakes until filled and stopped by switch 42.

Both pumps preferably run at a selected pumping rate. A faster rate is used on intake. This assures that each pump is filled adequately before starting.

The apparatus is free of flow rate surges dependent on materials selected. As an example, metal tubing connected between the valve 23 and the two pumps reduces the flow rate surges occurring when the pump stroke begins. The use of plastic tubing is permissible if flow rate surges can be tolerated. The relative dimensions of the transducer 20 can be varied to reduce surges. For example, the diaphragms in the transducer 20 can be made smaller to decrease surface area and hence reduce the volumetric displacement which in turn reduces pressure surges. Indeed, snap acting diaphragms closely spaced will provide a quick switch over and almost infinitesimal fluid displacement.

Other types of transducers include, for example, a pair of absolute pressure gages connected to a comparator which responds to polarity reversal or zero crossing; a differential gage connected to both pumps and driving a polarity reversal detector; piezoelectric crystals forming a signal which is frequency responsive and driving a pulse or frequency counter where the pulse rate is counted and compared; zero cross over detector connected to a differential gage.

The foregoing is directed to the preferred embodiment but the scope thereof is determined by the claims which follow.

I claim:

1. An improved pump which comprises:

first and second positive displacement pumps which have a chamber and a piston means therein, said piston means being connected to a piston rod and extending therefrom and driven by a motive means which reciprocates the piston rod to thereby pump fluid from the cylinder into an outlet line wherein each of said positive displacement pumps includes a valve means to selectively be connected to a downstream system and wherein the downstream system has a specific pressure and one of said pumps has a pump pressure equal to the downstream pressure and the other of said pumps has a pressure below the downstream pressure;

a pressure actuated transducer connected to the respective outlet lines of said pair of positive displacement pumps, said transducer means incorporating means responsive to pressure comparison cross over between the two pressures supplied thereto and further forming an output signal indicative of a pressure comparison cross over wherein the other of said pumps is brought up to a pressure matching the downstream pressure; and drive means respectively connected to the motive means for the respective pair of pumps, said drive means incorporating means responsive to the output signals supplied thereto to reverse operation of the positive displacement pumps on response to the signal from said pressure responsive switch means, said drive means further incorporating a switch which initiates pumping movement of one of said pumps at a point in the movement of the other of said pumps where the other pump has exhausted a portion of its displacement so that the first of said pumps is reversed and the other continues to pump at the pressure of the downstream system.

2. The apparatus of claim 1 wherein said drive means includes, for each pump, an electric motor which rotates through a specific angle of rotation on receiving a pulse thereto, and wherein said motors are driven by a pulse source connected to said motors.

3. The apparatus of claim 2 wherein said pressure actuated transducer is connected to a switching circuit to controllably supply driving pulses to said motors from said pulse source.

4. The apparatus of claim 1 wherein said pumps are each linearly stroked by a rack and first gear between said motive means and said piston rod.

5. The apparatus of claim 4 including two parallel racks and a second gear driven proportionately to the first gear which is engaged with said second rack and wherein said gears are located relative to said racks to clamp and align said piston and said racks which are attached thereto.

6. The apparatus of claim 1 including upper and lower limit switches for each of said pumps which prevent over travel by stopping said motive means.

7. The apparatus of claim 6 wherein said motive means are electric motors which are driven by a controllable pulse source having interposed therebetween a pulse reversal switch.

8. The apparatus of claim 1 wherein said pressure actuated transducer includes an electrical switch electrically isolated between said pump outlet lines and which is responsive to differential pressure acting thereon.

9. The apparatus of claim 8 wherein said transducer includes a cavity filled with electrically insulative liquid between the faces of two deflectable diaphragms which deflect to and fro to make electrically exclusive contact.

10. The apparatus of claim 1 wherein said pumps are connected to a solenoid operated output valve which is switched by the signal from said transducer.

11. The apparatus of claim 1 including an outlet valve connected to both of said pumps, and wherein said valve is operated by a signal from said transducer; and a controllable variable speed motor for each of said pumps which is altered in its operation on receiving a signal from said transducer.

12. The apparatus of claim 1 wherein said transducer incorporates a body having first and second communicated inlets for connection to the first pump, and said inlets permit a communicated flow path from said first pump to said transducer in route to an outlet valve.

* * * * *